US010018434B2

(12) United States Patent
Daley, Jr.

(10) Patent No.: US 10,018,434 B2
(45) Date of Patent: Jul. 10, 2018

(54) FIREARM RECEIVER WEAR SURFACE ASSEMBLY

(71) Applicant: Sig Sauer, Inc., Newington, NH (US)

(72) Inventor: William C. Daley, Jr., Kingston, NH (US)

(73) Assignee: SIG SAUER, Inc., Newington, NH (US)

( * ) Notice: Subject to any disclaimer, the term of this patent is extended or adjusted under 35 U.S.C. 154(b) by 0 days.

(21) Appl. No.: 15/619,819

(22) Filed: Jun. 12, 2017

(65) Prior Publication Data

US 2017/0356703 A1 Dec. 14, 2017

Related U.S. Application Data

(60) Provisional application No. 62/349,410, filed on Jun. 13, 2016.

(51) Int. Cl.
*F41A 3/66* (2006.01)
*F41G 11/00* (2006.01)

(52) U.S. Cl.
CPC ..... *F41A 3/66* (2013.01); *F41G 11/003* (2013.01)

(58) Field of Classification Search
CPC ..... F41A 3/44; F41A 3/64; F41A 3/66; F41A 21/12; F41A 35/00; F41C 27/00
See application file for complete search history.

(56) References Cited

U.S. PATENT DOCUMENTS 1,996,393 A * 4/1935 White ..... F41A 3/44 89/154
3,636,648 A * 1/1972 Spencer ..... F41A 3/64 42/16
3,742,638 A * 7/1973 Archer ..... F41A 3/30 42/16
3,996,684 A * 12/1976 Bauman ..... F41A 3/26 42/16
4,463,655 A * 8/1984 Krieger ..... F41C 27/00 89/196
4,473,964 A * 10/1984 Straub ..... F41A 25/22 124/68
4,579,034 A * 4/1986 Holloway ..... F41A 3/26 42/18
5,033,217 A * 7/1991 Brennan ..... F41A 3/64 42/1.01

(Continued)

*Primary Examiner* — Derrick R Morgan
(74) *Attorney, Agent, or Firm* — Finch & Maloney PLLC

(57) ABSTRACT

A wear surface assembly configured for use in a firearm receiver is disclosed. The disclosed assembly may include one or more wear surface members configured to be disposed within a receiver such that they physically intervene between the internal sidewalls of the receiver and either (or both) of the bolt carrier and cam pin head. In this manner, the disclosed assembly may serve to concentrate on itself any friction from the bolt carrier and cam pin head which otherwise would produce unwanted wear on the interior sidewalls of the receiver. The disclosed assembly may be configured to provide coverage of the receiver walls for the bolt carrier and cam pin head along the full (or at least partial) length of travel of the bolt carrier. The disclosed assembly further may include one or more retention pins configured to prevent the wear surface member(s) from dislodging from the receiver.

19 Claims, 8 Drawing Sheets

(56) References Cited

U.S. PATENT DOCUMENTS

| | | | | |
|---|---|---|---|---|
| 5,275,084 | A * | 1/1994 | Ruger | F41A 3/64 89/196 |
| 5,669,169 | A * | 9/1997 | Schmitter | F41A 3/66 42/71.02 |
| 9,354,005 | B1 * | 5/2016 | Russo | F41A 3/64 |
| 9,658,008 | B2 * | 5/2017 | Bero | F41A 3/66 |
| 2004/0007124 | A1 * | 1/2004 | Nakatani | F41A 3/64 89/196 |
| 2005/0223613 | A1 * | 10/2005 | Bender | F41A 3/36 42/16 |
| 2010/0000139 | A1 * | 1/2010 | Brown | F41A 3/66 42/96 |
| 2010/0319527 | A1 * | 12/2010 | Giefing | F41A 3/26 89/185 |
| 2012/0260553 | A1 * | 10/2012 | Gnesda | F41A 3/26 42/16 |
| 2012/0260793 | A1 * | 10/2012 | Gomez | F41A 3/66 89/191.01 |
| 2014/0165442 | A1 * | 6/2014 | Nebeker | F41A 3/64 42/16 |
| 2014/0260944 | A1 * | 9/2014 | Gryparis | F41A 3/12 89/180 |
| 2015/0059221 | A1 * | 3/2015 | Bero | F41A 3/66 42/16 |
| 2015/0276335 | A1 * | 10/2015 | Daley, Jr. | F41A 3/66 42/75.01 |
| 2015/0323269 | A1 * | 11/2015 | McGinty | F41A 11/00 42/16 |
| 2016/0209137 | A1 * | 7/2016 | DeSomma | F41A 3/82 |

* cited by examiner

FIREARM RECEIVER WEAR SURFACE ASSEMBLY

RELATED APPLICATIONS

This application claims benefit of U.S. Provisional Application No. 62/349,410, titled Firearm Receiver Wear Surface Assembly and filed Jun. 13, 2016.

FIELD OF THE DISCLOSURE

The disclosure relates to firearms and more particularly to firearms including a bolt carrier and a receiver.

BACKGROUND

Automatic and semi-automatic firearms typically include a bolt carrier that cycles backward and forward during operation. Depending on the particular firearm, movement of the bolt carrier may result from recoil of the firearm, expanding gases associated with the discharge of a round, or both. Considerations related to the design of firearm receivers may include the interaction between the bolt carrier and the receiver.

SUMMARY

One example embodiment of the present disclosure provides a wear surface assembly for a firearm receiver, the assembly including: a first wear surface member configured to be disposed within the firearm receiver between a bolt carrier and a first internal sidewall portion of the firearm receiver; and a first retention member configured to fix the first wear surface member in place within the firearm receiver; wherein: the first wear surface member is configured to prevent at least one of the bolt carrier and a cam pin head from being incident with the first internal sidewall portion of the firearm receiver along at least a portion of a path of travel of the bolt carrier within the firearm receiver; and the wear surface assembly is configured to be visually undetectable from an exterior of the firearm receiver when installed therein. In some cases, the first wear surface member is configured to prevent the at least one of the bolt carrier and cam pin head from being incident with the first internal sidewall portion along the entire path of travel of the bolt carrier within the firearm receiver. In some instances, the first retention member includes at least one of a pin and a screw and is configured to be: inserted within a first through-hole portion of the first wear surface member; and received by a first recess disposed in the first internal sidewall portion of the firearm receiver. In some cases, the assembly further includes: a second wear surface member configured to be disposed within the firearm receiver between the bolt carrier and a second internal sidewall portion of the firearm receiver; and a second retention member configured to fix the second wear surface member in place within the firearm receiver; wherein the second wear surface member is configured to prevent the at least one of the bolt carrier and the cam pin head from being incident with the second internal sidewall portion of the firearm receiver along at least a portion of the path of travel of the bolt carrier within the firearm receiver. In some such cases, the second retention member includes at least one of a pin and a screw and is configured to be: inserted within a second through-hole portion of the second wear surface member; and received by a second recess disposed in the second internal sidewall portion of the firearm receiver. In some other such cases, the first retention member and the second retention member constitute a monolithic component. In some other such cases, the first wear surface member and the second wear surface member are arranged parallel one another. In some other such cases, the first wear surface member and the second wear surface member are of different lengths. In some cases, the first wear surface member is comprised of a material having higher resistance to wear than a material of which the firearm receiver is comprised. In some cases, the first wear surface member constitutes a monolithic component.

Another example embodiment of the present disclosure provides a firearm receiver including: an upper receiver portion configured to host a bolt carrier and a cam pin; at least one elongate member disposed within the upper receiver portion such that it physically intervenes between the upper receiver portion and both the bolt carrier and the cam pin, extending along a length of the upper receiver portion in a region of travel of the bolt carrier; and at least one retention member disposed within the upper receiver portion such that the at least one elongate member is maintained in position within the upper receiver portion; wherein an exterior of the upper receiver portion is unmodified by the presence of the at least one elongate member and the at least one retention member therein. In some cases, the at least one elongate member includes a pair of first and second elongate members arranged parallel to one another. In some such cases, the first and second elongate members differ in at least one dimension. In some instances, the at least one elongate member includes at least one chamfered end portion configured to be incident with at least one of the bolt carrier and the cam pin. In some cases, the at least one retention member includes a U-shaped pin configured to be inserted through a top portion of the upper receiver portion and into the at least one elongate member. In some instances, the upper receiver portion is further configured to have a tactical rail operatively coupled therewith such that the tactical rail prevents the at least one retention member from dislodging from the upper receiver portion. In some cases, the at least one elongate member is comprised of at least one of aluminum (Al), titanium (Ti), molybdenum (Mo), chromium (Cr), nickel (Ni), carbon steel, and stainless steel.

Another example embodiment of the present disclosure provides a firearm including: a receiver portion; and a wear surface assembly integrated with the receiver portion, the assembly including: a first wear surface member; a second wear surface member disposed adjacent the first wear surface member; and at least one retention pin retaining at least one of the first wear surface member and the second wear surface member within the receiver portion; wherein the integrated wear surface assembly is not visible for an exterior of the receiver portion. In some instances, the firearm further includes a tactical rail operatively coupled with the receiver portion and configured to prevent the at least one retention pin from dislodging from the receiver portion. In some cases, the firearm is an assault rifle.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1A:
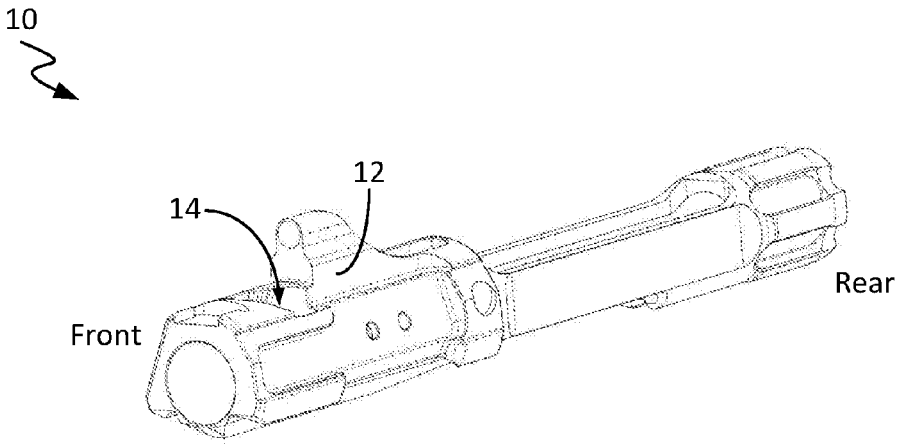
FIGS. 1A-1B illustrate perspective views of an example bolt carrier.

These and other features of the present embodiments will be understood better by reading the following detailed description, taken together with the figures herein described. In the drawings, each identical or nearly identical component that is illustrated in various figures may be represented by a like numeral. For purposes of clarity, not every component may be labeled in every drawing. Furthermore, as will be appreciated in light of this disclosure, the accompanying drawings are not intended to be drawn to scale or to limit the described embodiments to the specific configurations shown.

DETAILED DESCRIPTION

A wear surface assembly configured for use in a firearm receiver is disclosed. In accordance with some embodiments, the disclosed assembly may include one or more wear surface members configured to be disposed within a receiver such that they physically intervene between the internal sidewalls of the receiver and either (or both) of the bolt carrier and cam pin head. In this manner, the disclosed assembly may serve to concentrate on itself any friction from the bolt carrier and cam pin head which otherwise would produce unwanted wear on the interior sidewalls of the receiver. In accordance with some embodiments, the disclosed assembly may be configured to provide coverage of the receiver walls for the bolt carrier and cam pin head along the full (or at least partial) length of travel of the bolt carrier. In some embodiments, the disclosed assembly further may include one or more retention pins configured to prevent the wear surface member(s) from dislodging from the receiver. Numerous configurations and variations will be apparent in light of this disclosure.

General Overview

In typical firearms designs, the bolt carrier and cam pin are often made from a material of greater hardness than the upper receiver. Charging or other cycling of the firearm normally causes friction between the receiver and both the bolt carrier and cam pin head, resulting in wear on the receiver's interior sidewalls along the length of travel of the bolt carrier. The majority of the wear usually manifests on the left side within the upper receiver in the vicinity of the cam pin head. Wear also may manifest on the right side within the upper receiver as a result of reactionary forces involved in rotating the cam pin and the bolt. Moreover, wear on both the left and right interior surfaces of the upper receiver may be caused by virtue of the fact that, during operation, the bolt carrier slides along the interior of the upper receiver. Existing approaches to reducing internal wear provide coverage only for the cam pin head itself and are maintained in position within the host firearm via externally visible fasteners and related componentry generally considered to detract from the overall aesthetics of the firearm. Furthermore, to accommodate such componentry, through-holes or slots need to be formed in the upper receiver, weakening the overall firearm structure.

Thus, and in accordance with some embodiments of the present disclosure, a wear surface assembly configured for use in a firearm receiver is disclosed. In accordance with some embodiments, the disclosed assembly may include one or more wear surface members configured to be disposed within a receiver (e.g., an upper receiver) such that they physically intervene between the internal sidewalls of the receiver and either (or both) of the bolt carrier and cam pin head. In this manner, the disclosed assembly may serve to concentrate on itself any friction from the bolt carrier and cam pin head which otherwise would produce unwanted wear on the interior sidewalls of the receiver. In accordance with some embodiments, the disclosed assembly may be configured to provide partial or full coverage of the receiver walls for the bolt carrier and cam pin head along the length of travel of the bolt carrier. In some embodiments, the disclosed assembly further may include one or more retention pins configured to prevent the wear surface member(s) from dislodging from the receiver.

In accordance with some embodiments, the constituent wear surface member(s) of the disclosed assembly may be made of a material of greater hardness, and thus durability, than the host receiver. In some cases, a given wear surface member configured as variously described herein may be considered, in a general sense, a sacrificial component designed to save the host receiver from deterioration, experiencing wear itself instead. In some embodiments, the disclosed assembly may include only a single wear surface member configured to protect one side of a firearm receiver interior from wear caused by the bolt carrier and/or cam pin head. In some other embodiments, the disclosed assembly may include two or more wear surface members configured to protect one or more sides of a firearm receiver interior from such wear. As will be appreciated in light of this disclosure, the particular host receiver may be that of any of a wide range of firearms including either, or both, a bolt carrier and a cam pin, such as an assault rifle, for example.

In accordance with some embodiments, a wear surface assembly provided as variously described herein may be configured, for example, to be installed within a firearm receiver that is specifically manufactured to accommodate the physical presence and operation of that assembly. In accordance with some other embodiments, however, a wear surface assembly provided as variously described herein may be configured, for example, as a retrofit element to be installed within a firearm receiver which first is physically modified to accommodate the physical presence and operation of that assembly. More generally, a wear surface assembly provided as variously described herein may be configured for permanent and/or temporary installation within a host receiver, as desired for a given target application or end-use, and in some cases may be removable and/or replaceable in part or in whole.

In accordance with some embodiments, a wear surface assembly configured as variously described herein may be installed within a firearm receiver such that its presence is not discernible from the receiver's exterior. More particularly, contrary to existing designs, the disclosed assembly may be installed without any externally visible fasteners and related componentry, nor related through-holes or slots that breach the receiver. Thus, in some instances, the host receiver may remain more structurally rigid than existing designs. Moreover, the exterior of the host receiver may appear unmodified, having the assembly installed but no externally visible components or hardware. In some instances, the disclosed assembly may be installed in a manner that may be considered, in a general sense, more cosmetically appealing than traditional approaches which visibly alter the exterior of the host firearm.

In some cases, the disclosed assembly optionally may be configured such that its constituent components are swappable, interchangeable, or reversible. For instance, in some embodiments, the assembly may include two wear surface members that are identical in form and thus can be oriented and installed as desired on either side of a host receiver. In some other cases, the disclosed assembly optionally may be configured to be installed within a firearm receiver in only a single orientation. In some instances, the disclosed assembly may be configured for foolproof or otherwise repeatable and consistent installation. In some instances, a wear surface assembly provided as variously described herein may be configured, for example, as: (1) a partially/completely assembled receiver unit having an integrated wear surface assembly; and/or (2) a kit or other collection of discrete wear surface assembly components (e.g., one or more wear members, one or more retention pins, and so forth) which may be operatively coupled as desired.

Structure

Figure 1B:
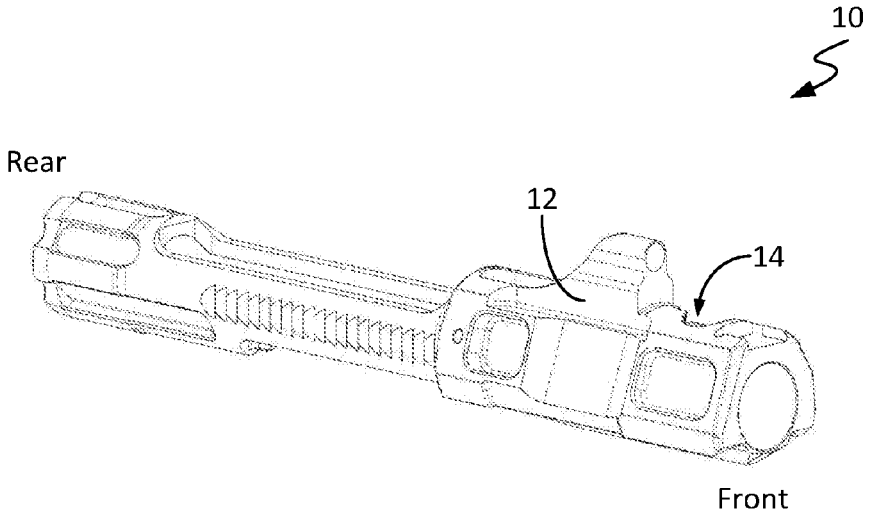
Figure 7:
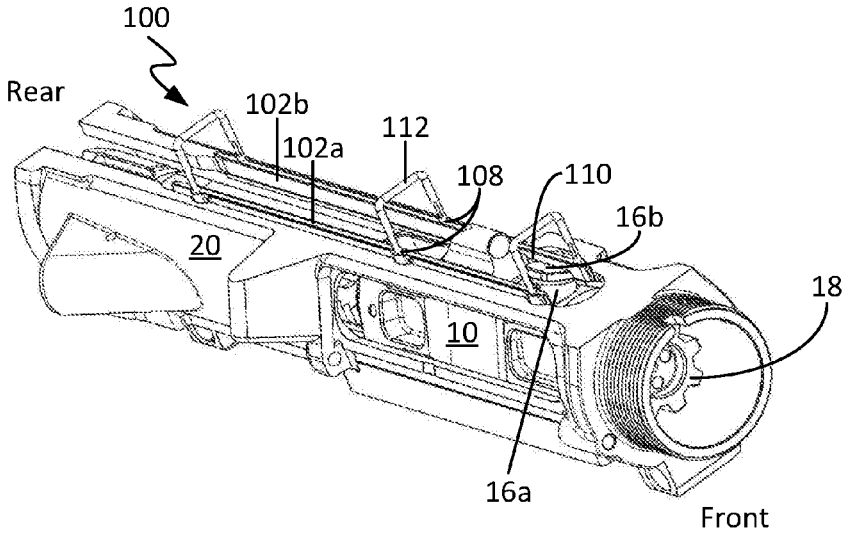
FIGS. 7, 8, and 9 illustrate perspective, top-down, and cross-sectional views, respectively, of a wear surface assembly installed in a receiver, in accordance with several embodiments of the present disclosure.

FIGS. 1A-1B illustrate perspective views of an example bolt carrier 10. During normal operation (e.g., charging, cycling, and so forth) of a host firearm, there are several external surfaces 12 on bolt carrier 10 that may be incident with internal sidewall regions of a firearm receiver 20 (FIG. 7). In some cases, bolt carrier 10 may be formed, in part or in whole, from a material that is of greater hardness than its host receiver 20. For instance, in some example cases, bolt carrier 10 may be formed from a steel, whereas receiver 20 may be formed from aluminum (e.g., anodized aluminum), magnesium, or an alloy of any thereof. Thus, without intervention, external surfaces 12 of bolt carrier 10 may physically interact with internal sidewall regions of receiver 20, causing wear (e.g., removal and/or deformation of material) along the length of travel of bolt carrier 10 within receiver 20. Also, as cam pin 16*a* (FIG. 7) moves forward or rearward within cam groove 14 of bolt carrier 10 during operation, cam pin head 16*b* may physically interact with interior sidewall regions of receiver 20, causing localized wear.

Figure 2:
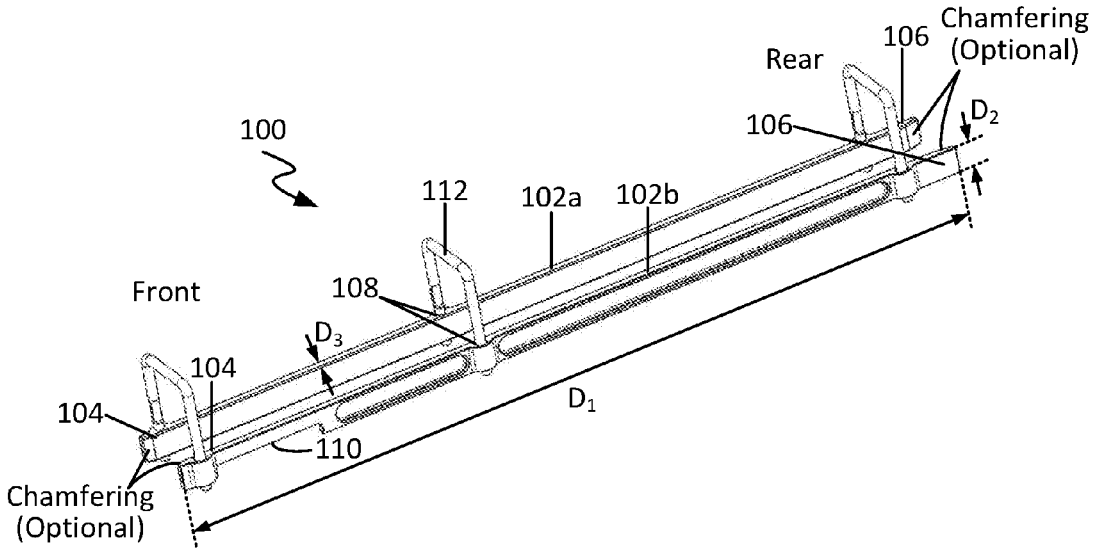
FIG. 2 illustrates a perspective view of a wear surface assembly configured in accordance with an embodiment of the present disclosure.

FIG. 2 illustrates a perspective view of a wear surface assembly 100 configured in accordance with an embodiment of the present disclosure. As can be seen, in some embodiments, assembly 100 may include a first wear surface member 102*a*, a second wear surface member 102*b*, and one or more retention members 112, each discussed in turn below. For consistency and ease of understanding of the present disclosure, first wear surface member 102*a* and second wear surface member 102*b* hereinafter may be collectively referred to generally as wear surface members 102, except where separately referenced. Wear surface assembly 100 may be configured, in accordance with some embodiments, for permanent and/or temporary installation within a host receiver 20, as desired for a given target application or end-use. In some cases, wear surface assembly 100 may be configured to be removable and/or replaceable in part or in whole.

In accordance with some embodiments, a given wear surface member 102 may be configured as a generally elongate, rail-like or bar-like body that is substantially linear in profile (e.g., such as generally can be seen in FIG. 2). A given wear surface member 102 may be configured, in accordance with some embodiments, to physically intervene between an interior sidewall region of a host receiver 20 and either (or both) bolt carrier 10 and cam pin head 16*b*. In this manner, a given wear surface member 102 may serve to concentrate mechanical wear on itself which otherwise would negatively affect host receiver 20. In accordance with some embodiments, either or both of first wear surface member 102*a* and second wear surface member 102*b* may include one or more surfaces that are substantially smooth and planar and thus configured to minimize or otherwise reduce friction and wear between such surface(s) and an exterior surface 12 of bolt carrier 10, cam pin head 16*b*, or both. In accordance with some embodiments, first wear surface member 102*a* and second wear surface member 102*b* may be configured to be disposed adjacent one another within a receiver 20 such that they are substantially parallel in arrangement (e.g., such as generally can be seen in FIG. 2). When installed, first wear surface member 102*a* and second wear surface member 102*b* may be disposed on (more or less) opposing sides of bolt carrier 10 within receiver 20, in accordance with some embodiments.

The particular geometry and dimensions of a given wear surface member 102 may be customized, as desired for a given target application or end-use. In some embodiments, a given wear surface member 102 may have a length ($D_1$) in the range of about 1-10 inches (e.g., about 1-2.5 inches, about 2.5-5 inches, about 5-7.5 inches, about 7.5-10 inches, or any other sub-range in the range of about 1-10 inches). In some embodiments, a given wear surface member 102 may have a height ($D_2$) in the range of about 0.1-0.8 inches (e.g., about 0.1-0.5 inches, about 0.5-0.8 inches, or any other sub-range in the range of about 0.1-0.8 inches). In some specific example cases, a given wear surface member 102 may have a height ($D_2$) of about 0.124±0.01 inches. In some specific example cases, a given wear surface member 102 may have a height ($D_2$) of about 0.124±0.001 inches. In some embodiments, a given wear surface member 102 may have a thickness ($D_3$) in the range of about 0.05-0.25 inches (e.g., about 0.05-0.15 inches, about 0.15-0.25 inches, or any other sub-range in the range of about 0.05-0.25 inches). It should be noted, however, that the present disclosure is not intended to be so limited only to these example dimension ranges, however, as dimensions greater than and less than those noted here may be provided for a given wear surface member 102, in accordance with other embodiments.

In some embodiments, first wear surface member 102*a* and second wear surface member 102*b* may be substantially the same in one or more dimensions. In some other embodiments, however, first wear surface member 102*a* and second wear surface member 102*b* may differ from one another in one or more dimensions. For instance, consider FIG. 3, which illustrates a wear surface assembly 100 configured in accordance with another embodiment of the present disclosure. As can be seen here, in some embodiments, second wear surface member 102*b* may be shorter in length ($D_1$) than first wear surface member 102*a*, or vice-versa. In some cases, rear ends 106 of first wear surface member 102*a* and second wear surface member 102*b* may be substantially aligned, whereas front ends 104 of first wear surface member 102*a* and second wear surface member 102*b* may be offset, extending to different lengths. In accordance with some embodiments, the difference in length ($\Delta D_1$) as between first wear surface member 102*a* and second wear surface member 102*b* may be in the range of about 0.5-1.5 inches (e.g., about 0.5-1.0 inches, about 1.0-1.5 inches, or any other sub-range in the range of about 0.5-1.5 inches). In some cases, the region of the difference in length ($\Delta D_1$) may serve to accommodate the physical presence of cam pin head 16*b*.

Figure 3:
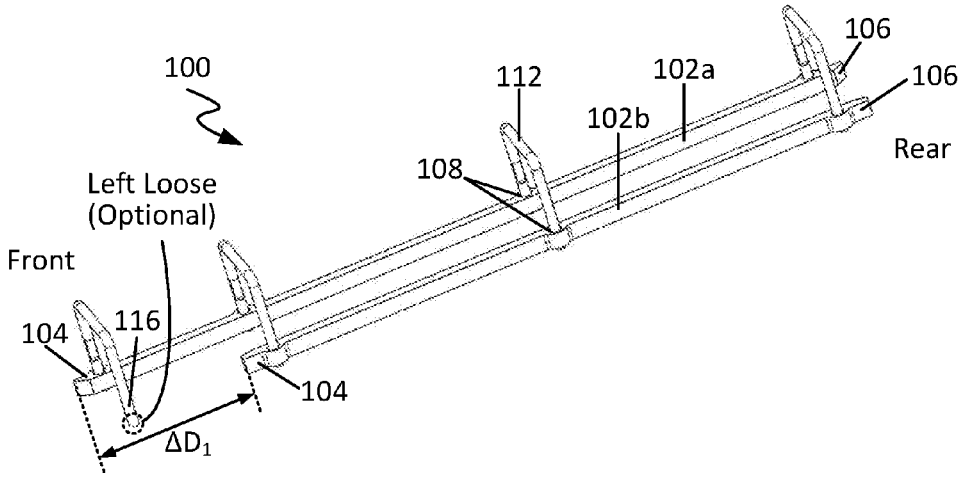
FIG. 3 illustrates a wear surface assembly configured in accordance with another embodiment of the present disclosure.

In accordance with some embodiments, a given wear surface member 102 may include along its length one or more through-hole portions 108 configured, for example, to receive therein a retention member 112 (discussed below). For a given wear surface member 102, the spacing and quantity of through-hole portions 108 may be customized, as desired for a given target application or end-use. In an example case, a given wear surface member 102 may include three through-hole portions 108 along its length (e.g., such as can be seen in FIG. 2). In another example case, a given wear surface member 102 may include four through-hole portions 108 along its length (e.g., such as can be seen in FIG. 3). In some cases, first wear surface member 102*a* and second wear surface member 102*b* may include the same quantity and distribution of through-hole portions 108 such that, across those wear surface members 102, through-hole portions 108 substantially align with one another. In some other cases, one wear surface member 102 may include a greater or lesser quantity of through-hole portions 108 than the other wear surface member 102, such as generally can be seen in FIG. 3, where first wear surface member 102*a* includes four through-hole portions 108, whereas second wear surface member 102*b* includes only three through-hole portions 108. Numerous configurations and variations will be apparent in light of this disclosure.

In accordance with some embodiments, either (or both) of a front end 104 and a rear end 106 of a given wear surface member 102 optionally may be chamfered, for example, to facilitate smooth physical interaction with a given portion of bolt carrier 10, cam pin head 16*b*, or both. As can be seen from FIG. 2, for example, in some embodiments, a given wear surface member 102 optionally may include a cam pin recess 110 configured to accommodate the physical presence of a cam pin head 16*b*. More particularly, as bolt carrier 10 travels forward or rearward, and cam pin 16*a* moves in its associated cam groove 14, cam pin head 16*b* may rotate in the region of cam pin recess 110 without interference from wear surface member 102. To that end, the particular dimensions and geometry of cam pin recess 110 may be customized, as desired for a given target application or end-use. In some instances in which a given wear surface member 102 is of sufficiently small height ($D_2$) or otherwise suitably positioned within receiver 20, a cam pin recess 110 may be omitted.

A given wear surface member 102 may be comprised, in part or in whole, of any of a wide range of suitable materials. For instance, a given wear surface member 102 may be comprised of any one, or combination, of aluminum (Al), titanium (Ti), molybdenum (Mo), chromium (Cr), nickel (Ni), a steel (e.g., a carbon steel, a stainless steel, AISI 1074 steel, AISI 1095 steel), or an alloy of any thereof, to name a few. In some embodiments, a given wear surface member 102 may be comprised of material(s) compliant, for example, with United States Defense Standard MIL-W-13855 (Weapons: Small Arms and Aircraft Armament Subsystems, General Specification For). As will be appreciated in light of this disclosure, the particular material composition of a given wear surface member 102 may be chosen, at least in some instances, based on its resistance to wear and thus its ability to contribute to the prevention (or other reduction) of wear of receiver 20, in accordance with some embodiments. In some embodiments, a given wear surface member 102 may be comprised of a material having higher resistance to wear than a material of which a host firearm receiver 20 is comprised. In some embodiments, a given wear surface member 102 may be comprised of a material of greater hardness than a material of which a host firearm receiver 20 is comprised. In some cases, a given wear surface member 102 optionally may have a coating disposed thereon which is resistant to corrosion, abrasion, or both.

In accordance with some embodiments, a given wear surface member 102 may be an element that has been forged, machined, stamped, or otherwise fabricated via any suitable standard, custom, or proprietary technique(s), as will be apparent in light of this disclosure. In some embodiments, a given wear surface member 102 may be formed as a monolithic component, whereas in some other embodiments, it may be formed as a plurality of elements that are affixed, adjoined, or otherwise disposed proximate one another, providing a multi-piece component. Other suitable materials, configurations, and dimensions for a given wear surface member 102 will depend on a given application and will be apparent in light of this disclosure.

As can be seen further from FIGS. 2-3, assembly 100 also may include one or more retention members 112. In accordance with some embodiments, a given retention member 112 may be configured to facilitate installation and retention of an associated wear surface member 102 within receiver 20 (as discussed in further detail below). A given retention member 112 may be configured, in accordance with some embodiments, to physically couple first wear surface member 102*a* and second wear surface member 102*b*, facilitating maintenance of their substantially parallel arrangement. To such ends, a given retention member 112 may be inserted within a given through-hole portion 108 of a given associated wear surface member 102, in accordance with some embodiments. More particularly, a given retention member 112 may be received and retained in mated engagement with a given through-hole portion 108 via an interference fit (e.g., friction fit), a threaded fit, a spring-biased fit, or any other suitable means, as will be apparent in light of this disclosure.

Figure 4:
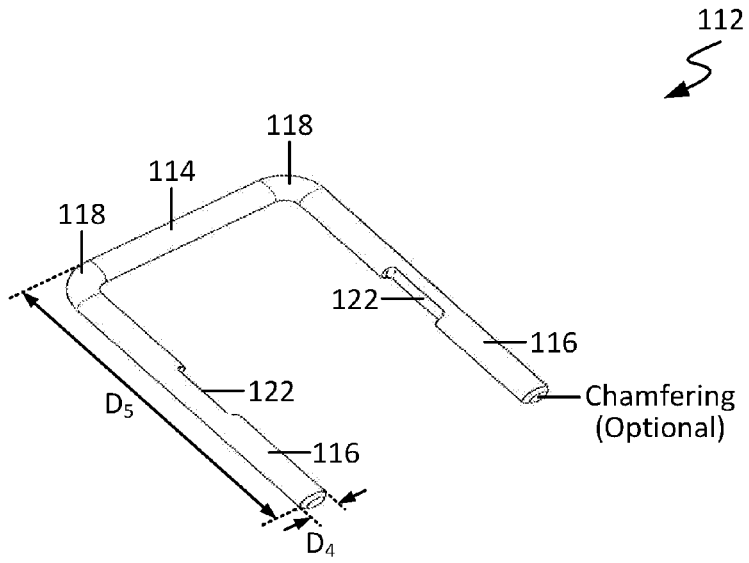
FIG. 4 illustrates a perspective view of a retention member configured in accordance with an embodiment of the present disclosure.

FIG. 4 illustrates a perspective view of a retention member 112 configured in accordance with an embodiment of the present disclosure. As can be seen here, in some embodiments, a given retention member 112 may be generally U-shaped (e.g., horseshoe-shaped; staple-shaped) in configuration, including one or more legs 116 that extend from a body portion 114 (e.g., at one or more elbow portions 118).

A given leg 116 may be configured to be inserted within or otherwise physically interfaced with either (or both): (1) a given through-hole portion 108 of a wear surface member 102; and (2) a given recess 24 in receiver 20. In some cases, the end of a given leg 116 optionally may be chamfered, for instance, to facilitate physical interfacing with a given through-hole portion 108 and a given recess 24 (FIG. 12) in receiver 20.

It should be noted, however, that the present disclosure is not intended to be so limited only to the example configuration of the retention member 112 of FIG. 4. For instance, in some other embodiments, a given retention member 112 may be an elongate body of generally cylindrical, box-like, or other prismatic shape. In some embodiments, a given retention member 112 may be a screw or other threaded component having at its end a drive feature such as a slotted head, a Phillips head, or a thumbscrew portion, to name a few. In some embodiments, a given retention member 112 may be a detent pin, a pin configured for bayonet mount fitting, or any other suitable member configured with one or more features that serve to maintain mated engagement between that retention member 112 and either (or both) of a through-hole portion 108 and a recess 24. In some embodiments, a given retention member 112 may be formed as a monolithic component, whereas in some other embodiments, it may be formed as a plurality of elements (e.g., a plurality of retention members 112) that are affixed, adjoined, or otherwise disposed proximate one another, providing a multi-piece component. Numerous suitable configurations and variations will be apparent in light of this disclosure.

The particular geometry and dimensions of a given retention member 112 may be customized, as desired for a given target application or end-use. In some cases, a given leg 116 (or other portion) of a given retention member 112 may have a cross-sectional diameter/width ($D_4$) in the range of about 0.05-0.2 inches (e.g., about 0.05-0.1 inches, about 0.1-0.15 inches, about 0.15-0.2 inches, or any other sub-range in the range of about 0.05-0.2 inches). In some specific example cases, a given retention member 112 may have a cross-sectional diameter/width ($D_4$) of about 0.068±0.01 inches. In some specific example cases, a given retention member 112 may have a cross-sectional diameter/width ($D_4$) of about 0.068±0.001 inches. In some instances, a given retention member 112 may have a length ($D_5$) in the range of about 0.4-1.2 inches (e.g., about 0.4-0.8 inches, about 0.8-1.2 inches, or any other sub-range in the range of about 0.4-1.2 inches). It should be noted, however, that the present disclosure is not intended to be so limited only to these example dimension ranges, however, as dimensions greater than and less than those noted here may be provided for a given retention member 112, in accordance with other embodiments.

In some cases, a given leg 116 (or other portion) of a given retention member 112 optionally may include a notched portion 122 configured to substantially align (e.g., become co-planar or otherwise flush) with a charging handle passageway 26 (FIG. 12) within receiver 20, thereby accommodating the physical presence of the host firearm's charging handle once installed. The particular geometry and dimensions of a given notched portion 122 may be customized, as desired for a given target application or end-use.

As will be appreciated in light of this disclosure, a given retention member 112 may be formed, in part or in whole, from any one, or combination, of the example materials discussed above, for instance, with respect to wear surface members 102, in accordance with some embodiments. In a specific example case, a given retention member 112 may be formed, at least in part, from a spring steel. Other suitable materials, configurations, and dimensions for a given retention member 112 will depend on a given application and will be apparent in light of this disclosure.

Example Installation and Operation

Figure 5:
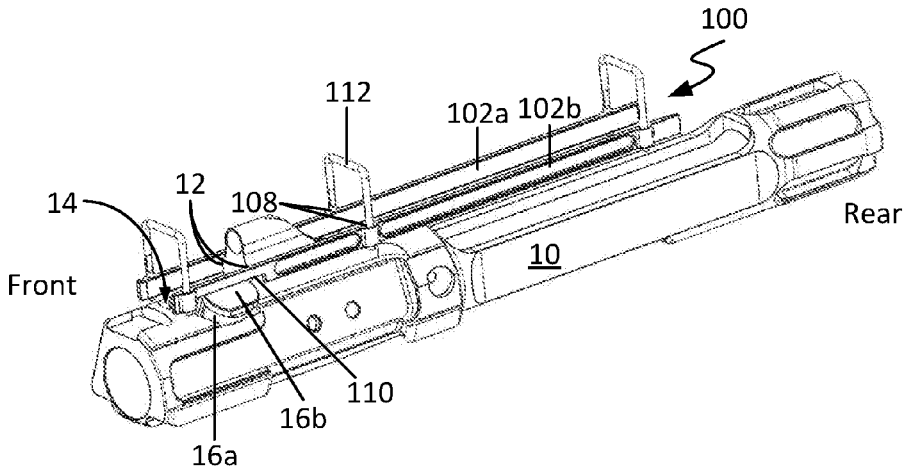
FIG. 5 illustrates a perspective view of an example bolt carrier and a wear surface assembly configured as in FIG. 2, in accordance with an embodiment of the present disclosure.
Figure 6:
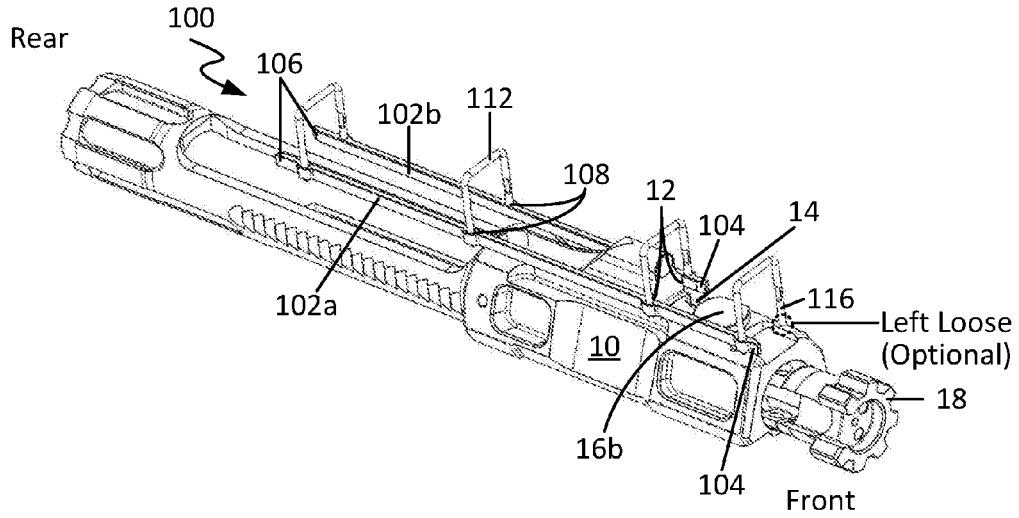
FIG. 6 illustrates a perspective view of an example bolt carrier and a wear surface assembly configured as in FIG. 3, in accordance with another embodiment of the present disclosure.
Figure 8:
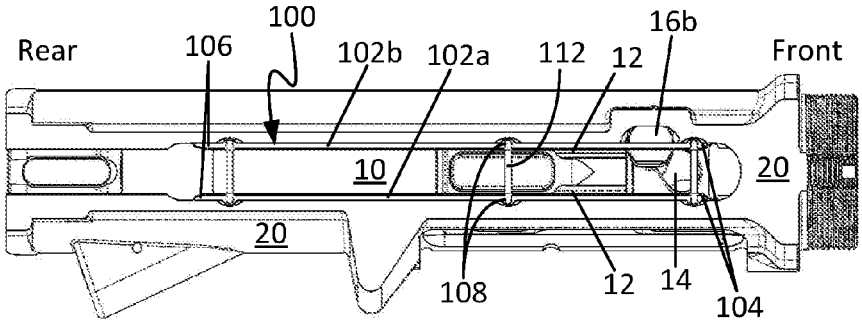
Figure 9:
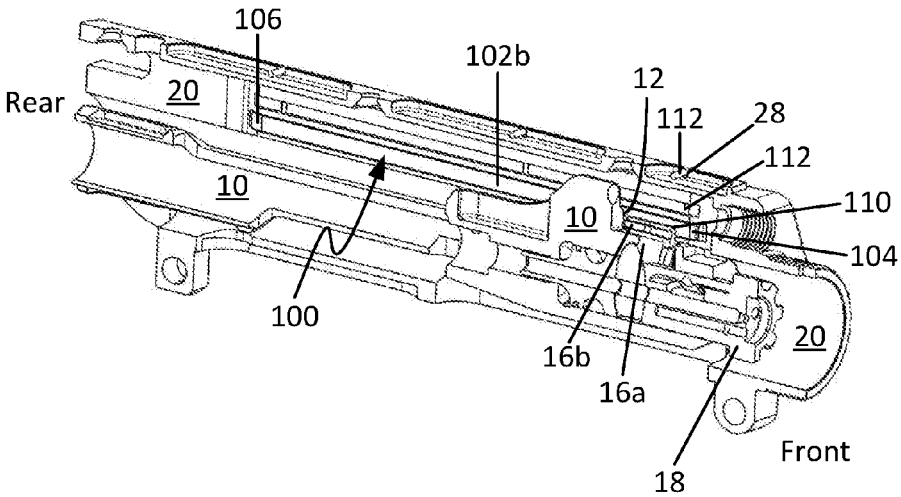

FIG. 5 illustrates a perspective view of an example bolt carrier 10 and a wear surface assembly 100 configured as in FIG. 2, in accordance with an embodiment of the present disclosure. FIG. 6 illustrates a perspective view of an example bolt carrier 10 and a wear surface assembly 100 configured as in FIG. 3, in accordance with another embodiment of the present disclosure. FIGS. 7, 8, and 9 illustrate perspective, top-down, and cross-sectional views, respectively, of a wear surface assembly 100 installed in a receiver 20, in accordance with several embodiments of the present disclosure. As can be seen from these figures, wear surface assembly 100 may be disposed within a receiver 20 (e.g., an upper receiver), in accordance with some embodiments, such that either (or both) of first wear surface member **102*a* and second wear surface member 102*b* intervene between exterior surfaces 12 of bolt carrier 10 and interior sidewall regions of receiver 20 along the path of travel of bolt carrier 10 within that receiver 20. In some cases, a given wear surface member 102 may provide protection along substantially the entire length of travel of bolt carrier 10, whereas in some other cases, only a portion of the length of travel may be protected. In some instances, a given wear surface member 102 may provide protection within the region in which cam pin head 16*b* resides. Wear surface assembly 100 may be configured, in accordance with some embodiments, for permanent and/or temporary installation within a host receiver 20**, as desired for a given target application or end-use, and in some cases may be removable and/or replaceable in part or in whole.

Figure 10:
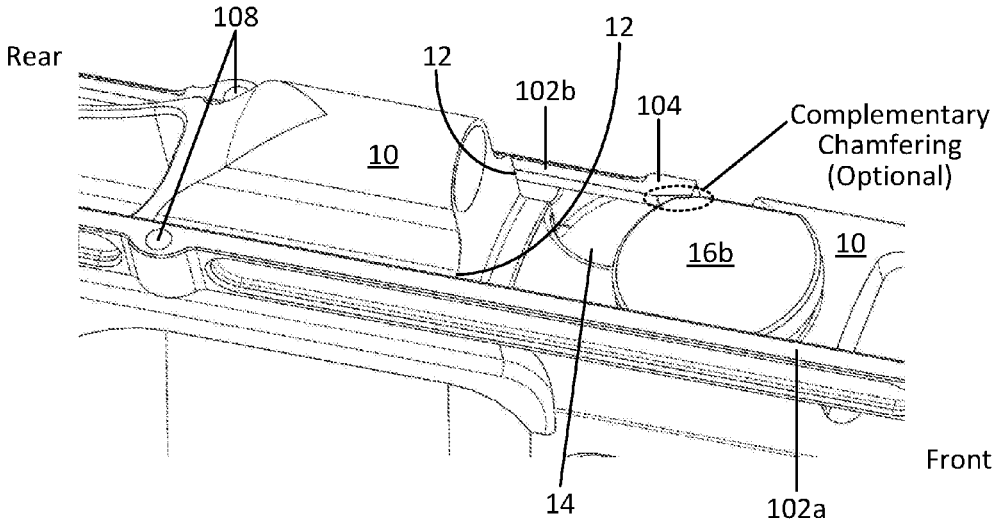
FIG. 10 illustrates a partial perspective view of a first wear surface member and a second wear surface member disposed alongside a bolt carrier and cam pin head, in accordance with an embodiment of the present disclosure.
Figure 11:
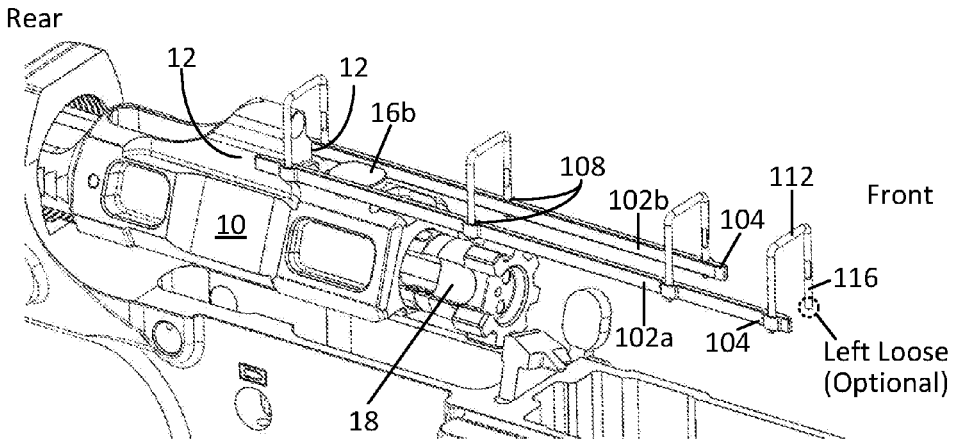
FIG. 11 illustrates a partial perspective view of a bolt carrier cycling rearward relative to a wear surface assembly, in accordance with an embodiment of the present disclosure.

FIG. 10 illustrates a partial perspective view of a first wear surface member **102*a* and a second wear surface member 102*b* disposed alongside a bolt carrier 10 and cam pin head 16*b*, in accordance with an embodiment of the present disclosure. FIG. 11 illustrates a partial perspective view of a bolt carrier 10 cycling rearward relative to a wear surface assembly 100, in accordance with an embodiment of the present disclosure. As can be seen, during cycling of a host firearm, cam pin head 16*b* may be incident with a given wear surface member 102 (e.g., second wear surface member 102*b*) rather than an interior sidewall region of a receiver 20 in which it is installed. As discussed above, in some embodiments, front end 104 of a given wear surface member 102 optionally may be chamfered, and in some such instances, the chamfering may be complementary to chamfering optionally provided on a portion of a cam pin head 16*b* with which it may be incident during operation of bolt carrier 10**.

Figure 12:
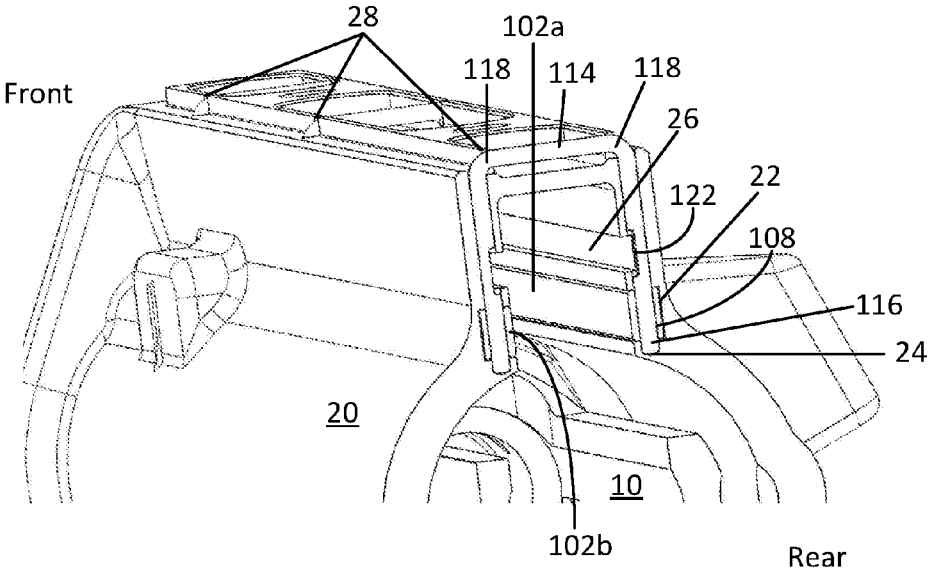
FIG. 12 illustrates a partial cross-sectional view of a receiver including a wear surface assembly installed therein, in accordance with an embodiment of the present disclosure.

FIG. 12 illustrates a partial cross-sectional view of a receiver 20 including a wear surface assembly 100 installed therein, in accordance with an embodiment of the present disclosure. In accordance with some embodiments, receiver 20 may include one or more channels 22 or other recesses configured to receive a given wear surface member 102. In accordance with some embodiments, a given wear surface member 102 may be inserted, slid, dropped, or otherwise maneuvered into position within a given channel 22. To that end, the geometry and dimensions of a given channel 22 may be customized, as desired for a given target application or end-use.

In accordance with some embodiments, a given wear surface member 102 may be retained within a given channel 22 via one or more retention members 112. To fix a given wear surface member 102 in place within receiver 20, a retention member 112 may be inserted through a through-hole portion 108 and received by a recess 24 in receiver 20, in accordance with some embodiments. In some instances, a retention member 112 may be inserted through a through-hole portion 108 of each of a first wear surface member 102*a* and a second wear surface member 102*b*, being received by one or more corresponding recesses 24. The particular location, dimensions, and geometry of a given recess 24 may be customized, as desired for a given target application or end-use. In some cases of multiple wear surface members 102, retention member(s) 112 may contribute to maintaining them in substantially parallel arrangement along the length of receiver 20. The quantity and spacing of retention members 112 may be customized, as desired for a given target application or end-use, and in some cases may be made to correspond (more or less) with the quantity and spacing of through-hole portions 108 of a given wear surface member 102.

In some cases, a given retention member 112 may be left floating or otherwise loose, in part or in whole, within receiver 20. For instance, as can be seen in the portions of FIGS. 3, 6, and 11 enclosed by dotted ellipses, a given leg 116 may not be inserted through a through-hole portion 108 of a given wear surface member 102, though it still may be received by a recess 24 in receiver 20. In an example case, if first wear surface member 102*a* and second wear surface member 102*b* are of different lengths ($D_1$), a given retention member 112 may physically interface with a through-hole portion 108 of one of those wear surface members 102 but not with a corresponding through-hole portion 108 of the other of those wear surface members 102.

In accordance with some embodiments, a given retention member 112 may be installed such that a notched portion 122 thereof substantially aligns (e.g., is co-planar or otherwise flush) with a charging handle passageway 26 within receiver 20. Thus, when installed, the charging handle of the host firearm may occupy passageway 26, indexing with notched portion(s) 122 of retention member(s) 112, in accordance with some embodiments.

In some cases, receiver 20 may include (e.g., at a top portion thereof) one or more notched portions 28 or other recesses with which a given retention member 112 may index. In an example case, an elbow portion 118 of a given retention member 112 may come to reside within a notched portion 28 formed in an upper region of receiver 20 (e.g., such as generally can be seen in FIGS. 9 and 12-13).

Figure 13:
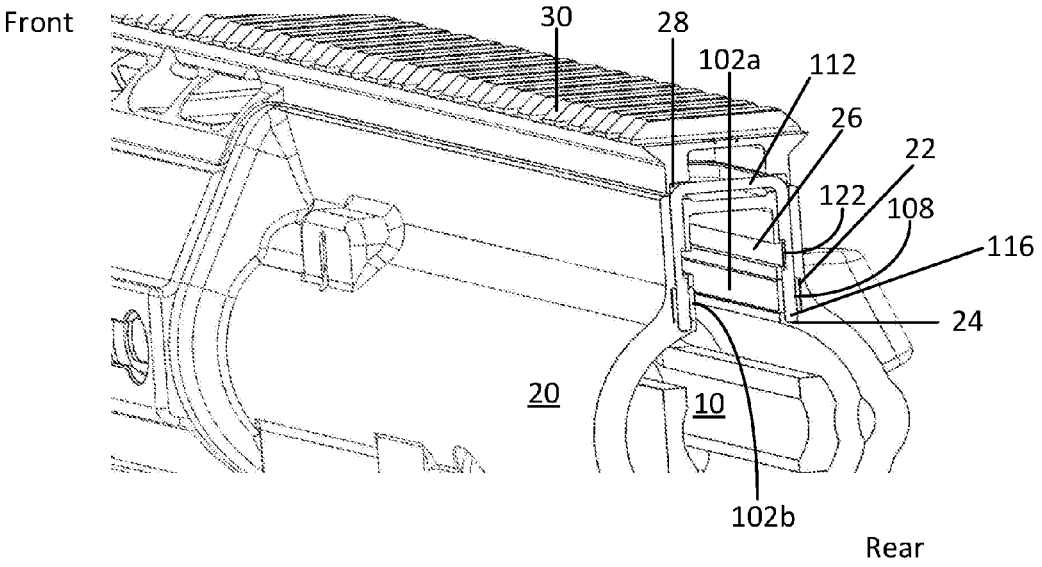
FIG. 13 illustrates a partial cross-sectional view of the receiver of FIG. 12 further including a tactical rail, in accordance with an embodiment of the present disclosure.

FIG. 13 illustrates a partial cross-sectional view of the receiver 20 of FIG. 12 further including a tactical rail 30, in accordance with an embodiment of the present disclosure. When mounted over receiver 20, tactical rail 30 (e.g., such as a Picatinny rail, Weaver rail, NATO accessory rail, and so forth) may enclose retention member(s) 112 within receiver 20. In some cases, tactical rail 30 may serve, at least in part, to physically retain retention member(s) 112 in notched portions 28, thereby preventing retention member(s) 112 from dislodging from receiver 20, helping to maintain positioning of either or both of first wear surface member 102*a* and second wear surface member 102*b* in receiver 20. Thus, in a general sense, tactical rail 30 may be configured to serve as an access cover for a wear surface assembly 100 installed within receiver 20, in accordance with some embodiments.

Figure 14A:
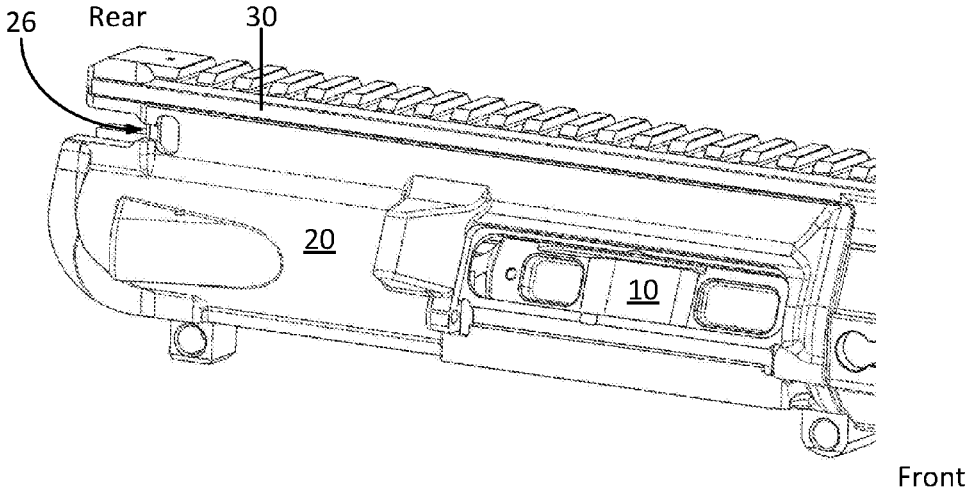
FIGS. 14A-14B illustrate partial perspective views of a receiver hosting a wear surface assembly configured in accordance with an embodiment of the present disclosure.
Figure 14B:
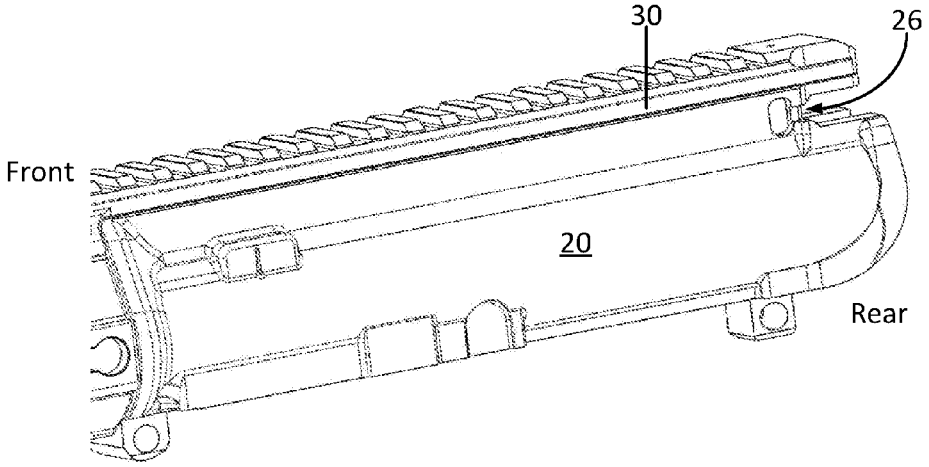

As previously noted, a wear surface assembly 100 configured as variously described herein may be installed within a receiver 20 such that its presence is not discernible from the exterior of receiver 20. FIGS. 14A-14B illustrate partial perspective views of a receiver 20 hosting a wear surface assembly 100 configured in accordance with an embodiment of the present disclosure. As can be seen here, there are no externally visible fasteners and related componentry, nor related through-holes or slots formed in receiver 20, contrary to existing designs. Moreover, the physical integrity of receiver 20 has not been compromised in accommodating the presence of a wear surface assembly 100, and thus receiver 20 is not structurally weakened, contrary to existing designs. Furthermore, contrary to existing designs, the exterior aesthetics of receiver 20 may remain unchanged even with the presence of a wear surface assembly 100.

Numerous variations and configurations will be apparent in light of this disclosure. The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A wear surface assembly for a firearm receiver, the assembly comprising:

a first wear surface member configured to be disposed within the firearm receiver between a bolt carrier and a first internal sidewall portion of the firearm receiver; and a first retention member configured to fix the first wear surface member and a second wear surface member in place within the firearm receiver;

wherein:

the first wear surface member is configured to prevent at least one of the bolt carrier and a cam pin head from being incident with the first internal sidewall portion of the firearm receiver along at least a portion of a path of travel of the bolt carrier within the firearm receiver; and the wear surface assembly is configured to be visually undetectable from an exterior of the firearm receiver when installed therein.

2. The assembly of claim 1 wherein the first wear surface member is configured to prevent the at least one of the bolt carrier and cam pin head from being incident with the first internal sidewall portion along the entire path of travel of the bolt carrier within the firearm receiver.

3. The assembly of claim 1 wherein the first retention member comprises at least one of a pin and a screw and is configured to be:

inserted within a first through-hole portion of the first wear surface member; and received by a first recess disposed in the first internal sidewall portion of the firearm receiver.

4. The assembly of claim 1, wherein the second wear surface member is configured to be disposed within the firearm receiver between the bolt carrier and a second internal sidewall portion of the firearm receiver, the second wear surface member is configured to prevent the at least one of the bolt carrier and the cam pin head from being incident with the second internal sidewall portion of the firearm receiver along at least a portion of the path of travel of the bolt carrier within the firearm receiver.

5. The assembly of claim 4 further comprising a second retention member.

6. The assembly of claim 4 wherein the first wear surface member and the second wear surface member are arranged parallel one another.

7. The assembly of claim 4 wherein the first wear surface member and the second wear surface member are of different lengths.

8. The assembly of claim 1 wherein the first wear surface member is comprised of a material having higher resistance to wear than a material of which the firearm receiver is comprised.

9. The assembly of claim 1 wherein the first wear surface member constitutes a monolithic component.

10. A firearm receiver comprising:

an upper receiver portion configured to host a bolt carrier and a cam pin, at least two elongate members disposed within the upper receiver portion such that the at least two elongate members physically intervene between the upper receiver portion and both the bolt carrier and the cam pin, extending along a length of the upper receiver portion in a region of travel of the bolt carrier; and at least one retention member disposed within the upper receiver portion and engaged with the two elongate members such that the at least two elongate members are maintained in position within the upper receiver portion;

wherein an exterior of the upper receiver portion is unmodified by the presence of the at least two elongate members and the at least one retention member therein.

11. The firearm receiver of claim 10 wherein the at least one elongate member comprises a pair of first and second elongate members arranged parallel to one another.

12. The firearm receiver of claim 11 wherein the first and second elongate members differ in at least one dimension.

13. The firearm receiver of claim 10 wherein the at least one elongate member includes at least one chamfered end portion configured to be incident with at least one of the bolt carrier and the cam pin.

14. The firearm receiver of claim 10 wherein the at least one retention member comprises a U-shaped pin configured to be inserted through a top portion of the upper receiver portion and into the at least two elongate members.

15. The firearm receiver of claim 10 wherein the upper receiver portion is further configured to have a tactical rail operatively coupled therewith such that the tactical rail prevents the at least one retention member from dislodging from the upper receiver portion.

16. The firearm receiver of claim 10 wherein the at least two elongate members are comprised of at least one of aluminum (Al), titanium (Ti), molybdenum (Mo), chromium (Cr), nickel (Ni), carbon steel, and stainless steel.

17. A firearm comprising:

a receiver portion; and a wear surface assembly integrated with the receiver portion, the assembly comprising:

a first wear surface member;

a second wear surface member disposed adjacent the first wear surface member; and at least one retention pin retaining the first wear surface member and the second wear surface member within the receiver portion;

wherein the integrated wear surface assembly is not visible for an exterior of the receiver portion.

18. The firearm of claim 17 further comprising a tactical rail operatively coupled with the receiver portion and configured to prevent the at least one retention pin from dislodging from the receiver portion.

19. The firearm of claim 17 wherein the firearm is an assault rifle.

* * * * *